United States Patent [19]

Mills

[11] Patent Number: 4,930,785

[45] Date of Patent: Jun. 5, 1990

[54] GOLF GRIP TRAINING APPARATUS

[75] Inventor: Paul A. Mills, Phoenix, Ariz.

[73] Assignee: KCAP Manufacturing, Inc., Phoenix, Ariz.

[21] Appl. No.: 402,546

[22] Filed: Sep. 5, 1989

[51] Int. Cl.[5] ..... A63B 69/36

[52] U.S. Cl. ..... 273/183 D; 273/81 A; 273/194 R

[58] Field of Search ..... 273/183 D, 186 A, 81 R, 273/193 R, 194 R, 162 R, 81 A

[56] References Cited

U.S. PATENT DOCUMENTS 3,323,367 6/1967 Searle ..... 273/183 D 3,762,720 10/1973 Jett ..... 273/183 D 4,840,371 6/1989 Harris ..... 273/183 D

*Primary Examiner*—George J. Marlo

*Attorney, Agent, or Firm*—H. Gordon Shields

[57] ABSTRACT

Golf club training apparatus includes a switch in an electrical circuit in a golf club handle, and the switch is activated in response to improper grip pressure during the golf club swing. The switch is connected to a motor in the shaft. The output shaft of the motor includes an eccentric weight which, when the motor is turned on, sets up vibrations in the club shaft and alerts the golfer of the improper pressure occurring while the user is swinging the golf club.

9 Claims, 1 Drawing Sheet

GOLF GRIP TRAINING APPARATUS

BACKGROUND OF THE INVENTION

1. Field of the Invention

This invention relates to golf club apparatus and, more particularly, to golf club apparatus which alerts a golfer that the grip on the golf club is improper.

2. Description of the Prior Art

As is well known and understood, a golfer's grip on the golf club shaft is very important. A particular problem is in the golfer increasing the pressure of the golfer's right hand during the swing. This is manifested by an increase in the thumb on the shaft of the golf club in the course of the swing. This increase in the pressure of the grip of the right hand has a deleterious effect on the golfer's swing in several respects. The improper swing results in problems in both accuracy and distance.

The apparatus of the present invention includes elements for alerting the user that the right hand thumb pressure has increased during the swing and accordingly allows the golfer to overcome the problem of increasing the right hand pressure.

U.S. Pat. No. 3,111,322 (English) discloses a golf club handle in which a plurality of finger pads extend outwardly from the surface of the handle. The finger pads may be biased by a spring or otherwise to provide an appropriate calibrated force for the respective fingers of the user's hands. An output signal is provided if excessive force is applied by the fingers.

U.S. Pat. No. 3,323,367 (Searle) discloses a golf club handle in which there is a built-in strain gauge so that handle pressure registers on the gauge secured to the gold club shaft. The user must refer to the gauge to determine the amount of pressure applied.

U.S. Pat. No. 3,436,076 (Barthol) discloses a baseball bat or a golf club handle which includes a sensor. The sensor detects when a ball is contacted by the bat or club and causes a flash of light output at the time of the impact. The apparatus is designed to provide psychological training so that the user maintains eye contact with the ball during the swing and the user is alerted by the flash of light at the time contact is made with the ball.

U.S. Pat. No. 3,687,458 (Proctor) discloses a golf club handle which includes a pivoting element that is springbiased outwardly against the user's hand. The spring force must be overcome to maintain the hands in the proper position on the golf club handle. If the gripping force by the user's hands does not sufficiently compress the spring, an uncomfortable grip results. The uncomfortable grip prevents the golfer from swinging the club properly. Both the left hand and the right hand are involved in overcoming the spring force.

U.S. Pat. No. 3,897,058 (Koch) discloses a training aid for the correct grip of a golf club, tennis racket, baseball bat, etc., that requires a pressure responsive grip. The apparatus includes a hollow handle connected to a pressure gauge so that the force of the user's hands can be sensed. The sensed pressure is remote from the user, and accordingly there is no sensation or output indication while the user is swinging. A third party apparently observes the output pressure. Since the sensing is remote, the handle being gripped is connected to the output responsive device by a cord. The cord is obviously a distraction or drawback for the user.

U.S. Pat. No. 3,918,721 (Trask) discloses a golf club training apparatus which includes a feeler attached to the golf club handle. The handle makes contact with either the user's arm or a sensor to provide an output signal resulting from an improper grip. The feeler is bent in such a manner that contact is made with the user's arm only if the arm moves in an improper manner. Devices other than the feeler may be used, such as output generator (buzzer) or the like. The feeler is flexible, and may be positioned in any appropriate manner to help correct any of several different types of grip or swing problems. However, it will be noted that the feeler gauge or output unit must be connected to the user's forearm in some manner. Again, like the cord in the '058 (Koch) patent, it may be a distraction for the user.

U.S. Pat. No. 4,103,896 (Lorang) discloses a golf club handle which includes a switch to be placed under the middle fingers of the off-target hand to provide an output signal if excessive pressure is applied by those fingers. Typically, the switch may be placed under the middle finger of the right hand to sense excessive pressure and to provide an output signal as a result of the excessive pressure.

U.S. Pat. No. 4,138,118 (Budney) discloses a strain gauge on the handle of a golf club to sense the pressure of the fingers on the handle. A plurality of strain gauges may be placed axially on the handle so that the pressure of the fingers at several locations on the handle may be sensed. The strain gauge(s) are connected to a pen recorder to record the output of the gauge(s) continuously during the swing. The apparatus requires a cord extending from the handle to the pen recorder, and accordingly has the same type of drawback that the '721 and '058 patents have.

SUMMARY OF THE INVENTION

The invention described and claimed herein comprises a golf club having a switch on the club handle disposed adjacent to the thumb of the right hand for sensing an increase in right hand pressure during the golf club swing. An output signal is provided within the golf club shaft in response to improper grip pressure during the swing. The amount of "improper" pressure required to activate the switch is adjustable for and/or by each individual user.

Among the objects of the present invention are the following:

To provide new and useful golf club apparatus;

To provide new and useful golf club apparatus for training a golfer for a proper swing;

To provide new and useful apparatus for providing an output signal in response to an improper amount of pressure on the golf club handle;

To provide new and useful apparatus for providing an output sensed by a golfer in response to a predetermined amount of improper grip pressure during a swing; and To provide new and useful golf club training apparatus for sensing an increase in the pressure of one hand during the swinging of a golf club.

DESCRIPTION OF THE PREFERRED EMBODIMENT

Figure 1:
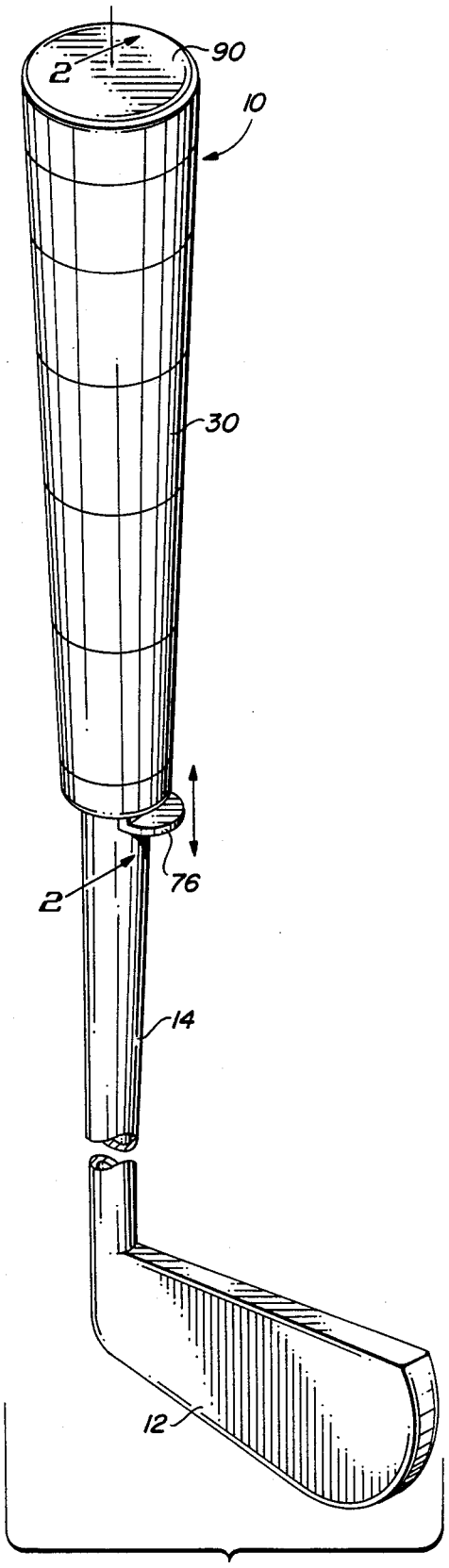
FIG. 1 is a perspective view of a portion of a golf club embodying the apparatus of the present invention.
Figure 2:
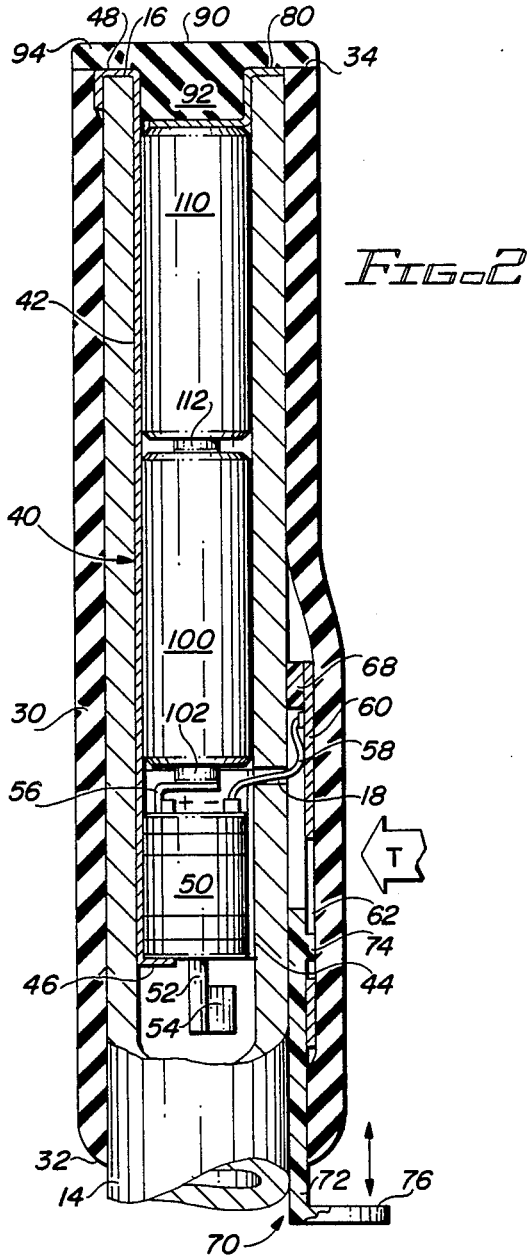
FIG. 2 is a view in partial section taken generally along line 2—2 of FIG. 1.

FIG. 1 is a perspective view of golf club apparatus 10 which includes the apparatus of the present invention. The golf club apparatus 10 includes a head 12 secured to a metal shaft 14. Disposed about the upper end of the shaft 14 is a grip 30. A cap 90 covers the top or upper end of the shaft 14 and the grip 30. FIG. 2 is a view in partial section taken through the shaft 2 at its upper end and through the strip 30. FIG. 2 is taken generally along line 2—2 of FIG. 1. For the following discussion, reference will primarily be made to FIGS. 1 and 2.

As is known and understood, the shaft 14 of a golf club 10 as generally made of metal. The shaft 14 includes an end 16 remote from the head 12. The grip 30 is generally made of some type of rubber disposed tightly about the upper end of the shaft 14. For purposes of the present invention, the grip 30 terminates adjacent to the end 16 of the shaft 14. The grip 30 cooperates with a portion of the apparatus of the present invention, as will be discussed below and as is illustrated in FIGS. 1, and 2. The grip 30 includes a tapered front end 32 and a rear end 34. The rear end 34 is adjacent to the end 16 of the shaft 14. The grip 30 is somewhat flexible, which allows elements of the present invention to be disposed beneath the grip 30 and on the outside of the shaft 14, as illustrated in FIG. 2 and as will discussed in detail below.

Figure 4:
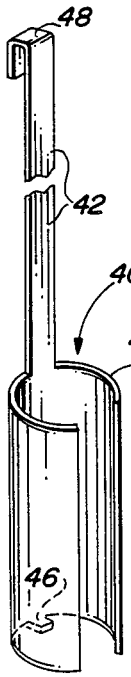
FIG. 4 is a perspective view of a portion of the apparatus of the present invention.

Within the hollow or cylindrical shaft 14, adjacent to the outer end 16, or inwardly from the outer end 16, is a carrier 40. The carrier 40 may be of any appropriate configuration, but as illustrated in detail in FIG. 4. FIG. 4 is a perspective view of the carrier 40. The carrier 40, as discussed herein, includes a longitudinally extending member or portion 42 and a partially open cylindrical portion 44 which is secured to the longitudinally extending member 42. The members 42 and 44 are appropriately connected to each other.

Remote from the cylindrical portion 44, there is a hook portion 48 which is hooked over the end 16 of the shaft 14. The hook portion 48 limits the downward movement of the carrier 40, and associated elements, such as batteries, into the shaft 14.

The carrier 40 includes a front end 46 extending radially inwardly from the cylindrical portion 44 remote from the member 42. The front end 46 is a radially extending element which comprises essentially a stop element for a motor 50 disposed within the carrier 40. The front end of the motor 50 bears against the element 46. An output shaft 52 of the motor 50 extends outwardly past the stop element 46 and outwardly from the carrier 40.

An eccentric weight 54 is secured to the shaft 52 outwardly beyond the end 46 of the carrier 40.

The motor 50 includes two electrical connectors, including a positive terminal connector 56 and a negative terminal conductor 58. The insulated negative conductor 58 extends through an opening or aperture 18 in the shaft 14.

The positive terminal connector 56 connects directly to a positive terminal portion 102 of a battery 100. Behind the battery 100 is a second battery 110. The battery 110 includes a positive terminal 112 which connects to the rear or negative terminal portion of the battery 100. Thus, the batteries 100 and 110 are serially connected together to provide electric current for the motor 50.

For connecting the negative terminal of the battery 110, which is the battery casing, specifically the rear end of the battery and, to the negative conductor 58, there is a conductive strip 60 disposed on the outside of the shaft 14 and separated from the shaft 14 by an insulator support element 68. The conductive strip 60 is appropriately secured to the negative terminal conductor 58, as by soldering, etc.

Figure 3:
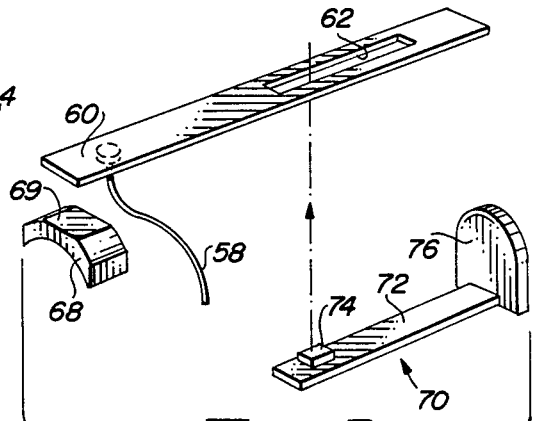
FIG. 3 is an exploded perspective view of a portion of the apparatus of the present invention.

FIG. 3 comprises an exploded perspective view of the conductive strip 60 and its associated elements, including the insulator support element 68 and a pressure adjuster element 70. For the following discussion, reference will be made to FIGS. 1, 2, and 3.

The conductive strip 60 includes an axially extending slot 62. The slot 62 is disposed at the "front" end of the strip 60, remote from where the conductor 58 is secured to the strip 60.

The support element 68 is a generally arcuately extending element which is appropriately secured, as by adhesive, to the exterior of the shaft 14 adjacent to the hole or aperture 18. The support element 68 includes a generally flat portion 69 on the top to receive the conductive strip 60. The strip is appropriately secured to the flat portion 69.

The pressure adjuster element 70 comprises a dielectric or insulator element. It includes a relatively flat strip 72. The width of the strip 72 is substantially the same as the width of the support element 68. The height or thickness of the strip 72 is sufficient to prevent inadvertent contact between the strip 60 and the shaft 14.

The strip 72 essentially performs two functions. The first function is to support the contact or switch strip 60 away from or off the shaft 14. The second function of the strip 72 is to adjust or vary the pressure required by a user to force or move the unsupported portion of the switch strip 60 into contact with the shaft 14. The "contact" completes the electric circuit to the motor 50. This will be discussed below.

Extending upwardly at one end of the strip 72 is a guide pin 74. The guide pin 74 extends through the slot 62 in the conductive strip 60. At the rear end of the strip 72, remote from the pin 74, is a tab 76. The tab 76 extends outwardly from beneath the front end 32 of the grip 30. This is shown in both FIGS. 1 and 2. The tab 76 allows the strip 72 to be adjusted relative to the strip 60 for purposes of adjusting the sensitivity of the strip 60 to the pressure of the user of the golf club apparatus 10.

By movement of the pressure adjuster element 70 relative to the conductive strip 60, the amount of pressure by the user's thumb on the outside of the grip 30 required to deflect the strip 60 to make contact with the metal shaft 14 may be adjusted or varied. The strip 60 is oriented with respect to the shaft 14 and to the head 12 such that the user's right thumb will be located in an area over the conductive strip 60. The pressure of the user's thumb is indicated by the large arrow in FIG. 2. A "T" is illustrated in the middle of the large arrow.

By an upward movement of the pressure adjuster element 70, or by movement of the strip 72 closer to the rear support 68, the greater the pressure required on the grip 30 to cause the deflection of the conductive strip 60 to make the grounding or circuit completing contact with the shaft 14. Thus, longitudinal movement of the pressure adjuster element 70 will vary the amount of thumb pressure required to activate the motor 50 by completing the electrical circuit to the motor 50. The circuit to the negative terminal of the battery 100 is through the shaft 14, the strip 60, and the conductor 58.

To insure good electrical connection between the negative terminal or end of the battery 110 and the shaft 14, there is a conductive strip 80 disposed between the end of the battery 110 and the end 16 of the shaft 14. A cap 90 is disposed on the end 16 of the shaft 14 and over the end 34 of the grip 30. The cap 90 includes a plug element or portion 92 and a radially outwardly extending flange 94. The flange 94 extends outwardly from the plug 92. The plug 92 extends onto the exterior of the shaft 16 to bias the conductive strip 80 against both the end of the battery 110 and the end 16 of the shaft 14.

If desired, the carrier 40 may be made of conductive material, and the conductive strip 80 may be an integral part of the carrier 40. The cap 90 may be made of conductive material or nonconductive material, as desired.

In use, a golfer places his hands about the grip 30 in a normal golf grip. In such case, the golfer's right thumb is placed in the area indicated by the large arrow "T" in FIG. 2. That is, the right thumb will be placed generally in the area of the conductive strip 60. Obviously, the parts of the golf club apparatus 10 shown in FIG. 2 are greatly exaggerated in dimension. In actual construction, the elements are relatively small, and thus there is only a slight outward bulge in the grip 30 in the area of the support element 68, the conductive strip 60, and the pressure adjuster element 70.

If the user's thumb pressure increases in the area of the large "T" of FIG. 2 during the downward swing, the conductive strip 60 will be deflected downwardly or radially inwardly to make contact with the shaft 14. When this occurs, the electrical connection to the motor 50 will be completed and the motor will turn on, causing the output shaft 52 to rotate.

With the eccentric weight 54 on the end of the shaft 52, there will be a vibration set up in the shaft 14 which will be noticeable to the golfer. Being thus aware of the pressure increase, the golfer may then adjust the grip to eliminate the undesirable increase in the pressure of the right hand during the downward swing. A decrease in the undesirable pressure breaks the electrical contact between the shaft 14 and the strip switch 60 and turns off the motor 50.

Since different golfers have different grip pressures, each golfer will need to move the pressure adjuster element 70 to the most appropriate location for accommodating the variations in hand pressure on the grip 30. By the longitudinal of vertical movement as shown in FIG. 2 of the adjuster element 70, the amount of pressure of the user's hand grip, and the desired amount of increased pressure, can be accommodated or adjusted to provide an "output signal" only upon the undesirable increase in thumb pressure.

While the principles of the invention have been made clear in illustrative embodiments, there will be immediately obvious to those skilled in the art many modifications of structure, arrangement, proportions, the elements, materials, and components used in the practice of the invention, and otherwise, which are particularly adapted to specific environments and operative requirements without departing from those principles. The appended claims are intended to cover and embrace any and all such modifications, within the limits only of the true spirit and scope of the invention.

What I claim is:

1. Golf swing training apparatus comprising a golf club having a conductive hollow shaft, an upper end on the shaft, a nonconductive grip on the shaft adjacent to said upper end and adapted to be gripped by a user's hands, motor means disposed in said shaft and having a pair of electrical connections for providing electrical current to cause the motor means to run;

battery means for providing an electric current for the motor means;

circuit means for connecting the battery means to the motor means, including first conductive means connecting the battery means to one of the pair of electrical connections of the motor means, and second conductor means connecting the battery means to the shaft; and switch means connecting the other of the pair of electrical connectors to the shaft in response to undesirable thumb pressure of one of the user's hands while swinging the golf club.

2. The apparatus of claim 1 in which the switch means includes a conductive strip disposed adjacent to the shaft and between the shaft and the grip and means for supporting the conductive strip adjacent to the shaft to prevent contact between the strip and the shaft except by the undesirable thumb pressure of the user while swinging.

3. The apparatus of claim 2 in which the switch means further includes a slide movable beneath the conductive strip to vary the pressure required to make contact between the strip and the shaft.

4. The apparatus of claim 3 in which the switch means further includes a slot in the conductive strip and a pin extending upwardly from the slide and into the slot and movable therein in response to movement of the slide to adjust the pressure required to cause the conductive strip to contact the shaft.

5. The apparatus of claim 4 in which the means for supporting the conductive strip includes an insulative support element secured to the shaft and to the conductive strip remote from the slide.

6. The apparatus of claim 1 in which the motor means includes an output shaft rotatable when the motor runs.

7. The apparatus of claim 1 in which the motor means further includes a weight eccentrically secured to the output shaft to provide an output signal to the user of the golf club.

8. The apparatus of claim 1 in which the circuit means further includes a conductive element extending between and electrically connecting the battery means and the shaft.

9. The apparatus of claim 1 in which the motor means includes a motor and a carrier for supporting the motor in the shaft.

* * * * *